United States Patent [19]

Nagatsuma

[11] Patent Number: 5,062,342

[45] Date of Patent: Nov. 5, 1991

[54] PIANO ACTION DEVICE FOR ELECTRONIC KEYBOARD MUSICAL INSTRUMENTS

[75] Inventor: Shigeyuki Nagatsuma, Hamura, Japan

[73] Assignee: Casio Computer Co., Ltd., Tokyo, Japan

[21] Appl. No.: 455,977

[22] Filed: Dec. 22, 1989

[30] Foreign Application Priority Data

Dec. 28, 1988 [JP] Japan ..... 63-169125[U]
Dec. 28, 1988 [JP] Japan ..... 63-169126[U]

[51] Int. Cl.[5] ..... G10C 3/12; G10H 1/34

[52] U.S. Cl. ..... 84/744; 84/439; 84/440; 84/DIG. 7

[58] Field of Search ..... 84/439, 440, 687, 718–720, 84/743–745

[56] References Cited

U.S. PATENT DOCUMENTS

| | | | |
|---|---|---|---|
| 3,101,640 | 8/1963 | Hartman | 84/238 X |
| 3,634,593 | 1/1972 | Nagano | 84/600 |
| 3,903,780 | 9/1975 | Aliprandi | 84/433 |
| 3,927,594 | 12/1975 | Morita | 84/237 |
| 4,286,493 | 9/1981 | Hardesty et al. | 84/237 |
| 4,314,494 | 2/1982 | de Vries | 84/729 |
| 4,679,477 | 7/1987 | Monte | 84/719 |
| 4,723,471 | 2/1988 | Sugimoto | 84/439 |
| 4,913,026 | 4/1990 | Kaneko et al. | 84/21 |

FOREIGN PATENT DOCUMENTS

| | | |
|---|---|---|
| 50-153914 | 12/1975 | Japan . |
| 61-124098 | 8/1986 | Japan . |
| 61-206978 | 12/1986 | Japan . |
| 63-128397 | 5/1988 | Japan . |
| 63-33239 | 9/1988 | Japan . |

*Primary Examiner*—William M. Shoop, Jr.
*Assistant Examiner*—Brian Sircus
*Attorney, Agent, or Firm*—Frishauf, Holtz, Goodman & Woodward

[57] ABSTRACT

A piano action device for electronic keyboard musical instruments includes a key arranged on a keyboard chassis so as to be swingable up and down, a first hammer arm swung in response to the depression of the key, switch unit for indicating a start of generating musical sounds to be generated when it is pushed, and a second hammer arm swung in response to the swinging of the first hammer arm to push the switch unit.

5 Claims, 16 Drawing Sheets

PIANO ACTION DEVICE FOR ELECTRONIC KEYBOARD MUSICAL INSTRUMENTS

BACKGROUND OF THE INVENTION

1. Field of the Invention

The present invention relates to a piano action device for electronic keyboard musical instruments such as the electronic piano and organ and, more particularly, it relates to a piano action device by which the player can feel as if he or she were playing the acoustic piano even though he or she is playing the electronic keyboard musical instrument in fact.

2. Description of the Related Art

When a key is depressed in the acoustic piano, the force applied to the key is transmitted to a hammer through a wippen and a jack, and the hammer is thus swung to beat a string to create a musical sound. At the first step of depressing the key, therefore, load applied to the finger of the player becomes quickly heavy because of the reaction force of the wippen etc. but it becomes quickly light at the middle step because the hammer is made free.

In the case of the electronic keyboard musical instruments such as the electronic piano, however, any of musical sounds is created by the switch operation which is made operative when the corresponding key is depressed by the player. Therefore, the feeling of the player obtained when he or she depresses the keys of electronic keyboard musical instruments is quite different from his or her feeling obtained when he or she depresses the keys of the acoustic piano.

In the case of a conventional electronic keyboard musical instrument disclosed, for example, in published and unexamined Japanese Patent Application No. 50-153914 (which corresponds to U.S. Pat. No. 3,903,780), published and unexamined Japanese Utility Model Application Nos. 61-124098 and -206978 (which correspond to U.S. Pat. No. 4,723,471), a predetermined load is applied to a key when this key is depressed, thereby enabling the player to feel as if he or she were depressing the key of the acoustic piano.

When a key of the acoustic piano is depressed and its touch becomes quickly light on the way of its key stroke, the corresponding hammer beats the corresponding string to generate a musical sound. In the case of the above-mentioned electronic keyboard musical instruments, however, the key touch of each of the keys does not change quickly until the key makes the corresponding switch operative at the final of its key stroke, because the switches are directly operated by the keys. When quick and light depressions are applied to the keys of the conventional electronic keyboard musical instruments, therefore, it sometimes happens that some of the keys are not depressed enough to make the corresponding switches operative.

Even in the case of those electronic keyboard musical instruments which include first and second switches arranged for every key to achieve touch response function, the same trouble as described above is caused. When a key of the electronic keyboard musical instrument of this type is depressed, the first and second switches are successively made operative with a time difference (t). When the second switch is made operative, key-on data is supplied to a sound source means to generate a musical sound, while touch response data which corresponds to the time difference (t) (keydepressing speed), more specifically, data for determining musical sound parameters such as the sound volume and tone color of the musical sound generated from the sound source, which corresponds to the keydepressing speed, is also supplied to the sound source means.

The two switches are made operative directly by their corresponding key. When quick and light depressions are applied to the keys, therefore, it sometimes happens that the first switches of some keys are put on, while leaving the second switches of these keys off. As the result, those musical sounds which correspond to these unoperated keys are not created even though the keys are depressed.

Published and unexamined Japanese Patent Application No. 63-128397, published and examined Japanese Utility Model Application No. 63-33239, and U.S. Pat. No. 3,634,593 disclose another electronic keyboard musical instrument wherein hammer arms are freely swingably arranged under the keyboard chassis to apply action load to keys, and they are swung by depressing the keys to push their corresponding switches which are attached to the keyboard chassis to detect touch response data.

Key touch or depress feeling substantially similar to that obtained when keys of the acoustic piano are depressed by fingers can be obtained while playing the electronic keyboard musical instrument. In addition, the switches for detecting touch response data can be surely put on by the inertia of their swinging corresponding hammer arms, even when depressing of their keys are not sufficient. If the keys are not moved to the last of their stroke but depressed only by a certain distance, therefore, musical sounds which correspond to the depressed keys can be surely generated. Even when quick and light depressions are applied to the keys of this electronic keyboard musical instrument. Therefore, musical sounds which correspond to the depressed keys can be created, as seen in the case of the acoustic piano.

When keys are strongly depressed in the case of the conventional electronic keyboard musical instruments, however, their hammers cannot follow but swing prior to displacements of depressed keys. This causes action load, which is applied to the keys by their hammers, to be instantly released from the key at a certain point in the key stroke. The player is bewildered at this instant because the depression force for the depressed key becomes quickly light.

SUMMARY OF THE INVENTION

The present invention is contrived to eliminate the above-mentioned drawbacks of conventional electronic keyboard musical instruments.

An object of the present invention is to provide a piano action device which is used in electronic keyboard musical instruments and reliably causes musical sounds to be generated in response to the depressed keys even when quick and light depressings are applied to these keys.

Another object of the present invention is to provide a piano action device which is used in electronic keyboard musical instruments and prevents action load, which is applied to keys through hammers, from being instantly released from the keys even when these keys are strongly depressed.

DETAILED DESCRIPTION OF THE PREFERRED EMBODIMENTS

First Embodiment

Figure 1:
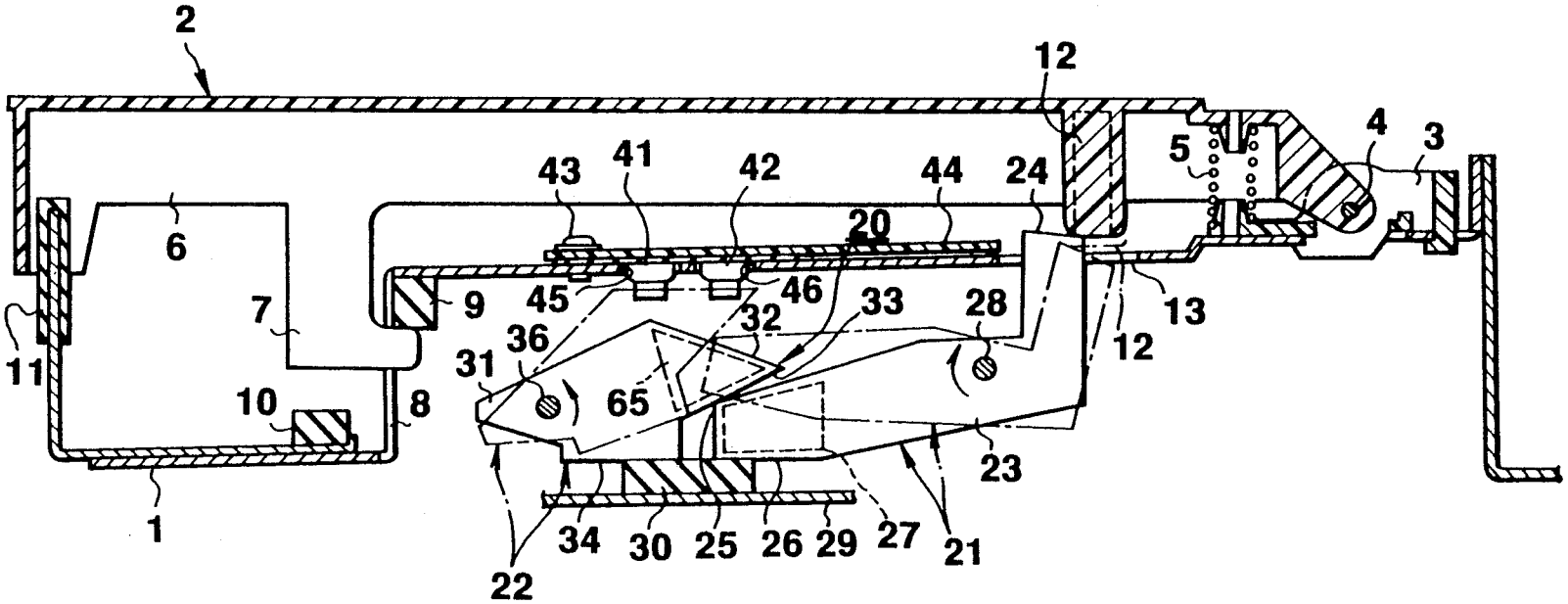
FIG. 1 is a longitudinal sectional view schematically showing a main part of a first embodiment of a piano action device, which is used in electronic keyboard musical instruments, according to the present invention.

FIG. 1 schematically shows a longitudinal section of a main part of a first embodiment of a piano action device, used in an electronic keyboard musical instrument and according to the present invention.

A plurality of white and black keys made of synthetic resin are arranged side by side on an upper surface of keyboard chassis 1 made by a metal plate. Only white key 2 is shown in FIG. 1. The rear end portion of white key 2 is attached on rod 4 supported by key support member 3, made of synthetic resin and mounted on the rear end portion of the upper surface of keyboard chassis 1, so that white key 2 is swingable around shaft 4 in a vertical direction. Compression coil spring 5 is interposed between the lower surface of the rear end portion of key 2 and key support member 3. Key 2 is urged upward by the urging force of compression coil spring 5, and substantially L-shaped stopper 7 projected downward from side plate 6 at the front end portion of key 2 is inserted into through-hole 8 of keyboard chassis 1. Stopper 7 contacts stripe-like buffer member 9 attached to the undersurface of keyboard chassis 1 and made of felt or the like so that stopper 7 is held at its predetermined initial (or top) position. Another stripe-like buffer member 10 made of felt and serving to define the final (or bottom) position of key 2 is mounted at a portion on the upper surface of keyboard chassis 1, which is located below stopper 7 to correspond to the lower edge of stopper 7. Guide member 11 is mounted on the front end portion of keyboard chassis 1 to prevent key 2 from swinging in the horizontal direction. Further, hammer-pushing projection 12 having a substantially H-shaped horizontal section is formed on the rear end portion of the lower surface of key 2.

Hammer arm mechanism 20 for applying action load to key 2 is located in front of stopper 7 of key 2 and under keyboard chassis 1. Hammer arm mechanism 20 is constructed of first and second hammer arms 21 and 22, both of which extends in the longitudinal direction of key 2. In first hammer arm 21, the upper edge of an upwardly extending branch mounted on the front end of body 23 made of synthetic resin forms pressing-force receiving surface 24, and the upper edge of the rear end portion of body 23 forms pushing-up surface 25. The lower edge of the rear end portion of its body 23 forms stopper surface 26, and weight 27 is mounted in the rear end portion of body 23. First hammer arm 21 is attached to musical-instrument body housing 29 through shaft 28 so as to be swingable around shaft 28 in the vertical direction, and is urged in a counter-clockwise direction by weight 27. First hammer arm 21 is in contact at its stopper surface 26 with stripe-shaped buffer member 30 mounted on body housing 29 and made of felt or the like, so that first hammer arm 21 is held at a predetermined initial position. When first hammer arm 21 is at its initial position before depressing key 2, the upwardly-extending branch of body 23 is inserted into through-hole 13 of keyboard chassis 1, and its pressure-receiving surface 24 slightly contacts with or opposes the lower end surface of hammer pushing projection 12 of key 2 with a small gap therebetween.

In second hammer arm 22, the upper surface of the front end portion of its body 31 made of synthetic resin and extending in the longitudinal direction of key 2 forms switch-pushing surface 32 which is inclined forwardly and downwardly, and the lower surface of the above described front end portion forms pushing-up force receiving surface 33 which is inclined forwardly and upwardly. The lower end surface of downward-projected portion of body 31 serves as stopper surface 34, and weight 65 is mounted in the front end portion of body 31. Second hammer arm 22 is attached to musical-instrument body housing 29 through shaft 36 so as to be swingable around shaft 36 in the vertical direction. Second hammer arm 22 is urged in the clockwise direction by the action of weight 65. Second hammer arm 22 is in contact at its stopper surface 34 with buffer member 30 mounted on the body housing 29 so that hammer arm 22 is held at its initial position before depressing key 2. At the initial position, pushing-up force receiving surface 33 of the rear end portion of second hammer arm 22 is slightly contacting pushing-up portion 25 of the front end portion of first hammer arm 21 or separated therefrom with a small gap therebetween.

First and second switches 41 and 42 of the push type are arranged above switch-push surface 32 of the front end portion of second hammer arm 22 so as to be separated from each other in the longitudinal direction of key 2. First and second switches 41 and 42 are mounted on the lower surface of circuit board 44 which is attached onto keyboard chassis 1 by screw 43, and they are projected downward through through-holes 45 and 46 of keyboard chassis 1.

Figure 2:
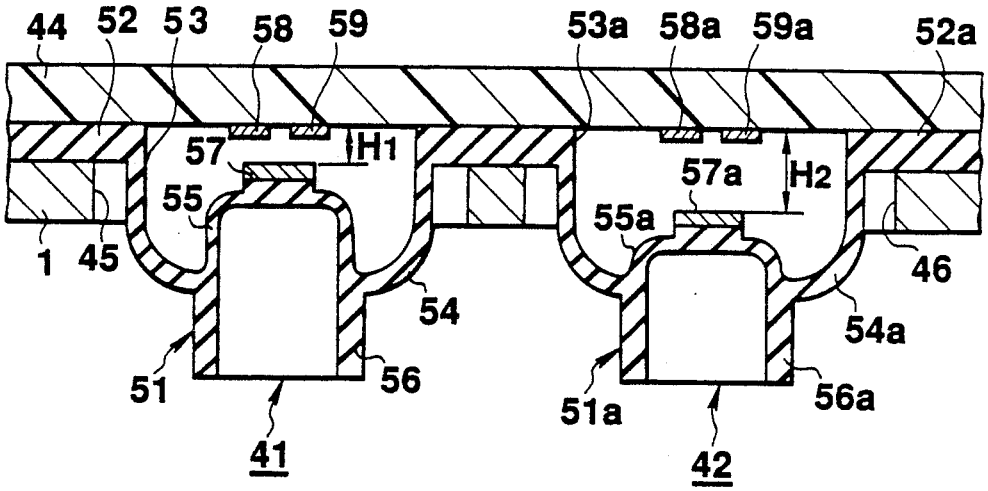
FIG. 2 is an enlarged longitudinal sectional view schematically showing first and second switches of the piano action device of FIG. 1.
Figure 3:
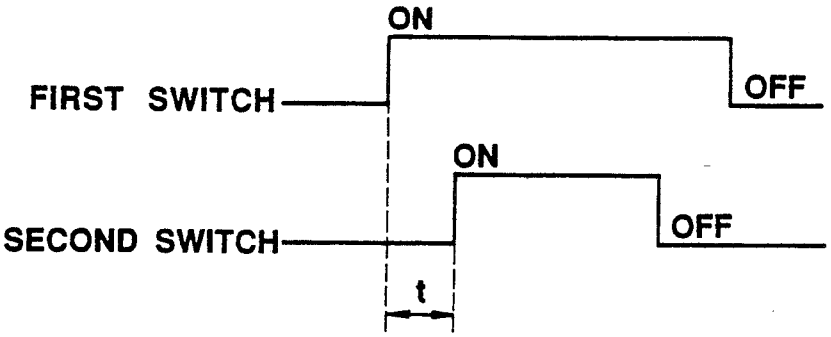
FIG. 3 is a chart schematically showing timings at which the first and second switches are put on and off.

First and second switches 41 and 42 are arranged as shown in FIG. 2. Body 51 of first switch 41 is made of elastic material such as rubber, and includes sheet-like locating portion 52 overlain on the lower surface of circuit board 44, dome-like outer wall portion 54 projecting downward from locating portion 52 cap-like contact portion 55 projecting upward from the lower end (downwardly projected end) portion into inner space 53 of outer wall portion 54, and cylindrical pressing-force receiving portion 56 projecting downward from the lower end (downwardly projected end) portion of outer wall portion 54. Movable contact 57 made of conductive paint or the like is mounted on the upper surface of the projected end portion of contact portion 55 of first switch 41. A pair of fixed contacts 58 and 59 are mounted at a position, opposed to movable contact 57, on the lower surface of circuit board 44.

Second switch 42 is fundamentally the same in construction as first switch 41. Same parts as those of first switch 41 will be therefore denoted by the same reference numerals to which the letter "a" is appended, and description of these parts will be omitted. Second switch 42 is different from first switch 41 only in that distance H2 between movable contact 57*a* on contact portion 55*a* formed on the projected end portion of second switch 42 and the lower surface of circuit board 44 is made longer than distance H1 between movable contact 57 formed on contact portion 55 of first switch 41 and the lower surface of circuit board 44. As will be described later, the difference between distances H2 and H1, respectively is intended to first close switch 41 and then close second switch 42 with a certain time difference (t) when they are pushed by switch-push surface 32 of second hammer arm 22.

Sheet-like locating portions 52 and 52*a* are common to those of first and second switches corresponding to the other keys, and they are sandwiched between the upper surface of keyboard chassis 1 and the lower surface of circuit board 44.

When key 2 is depressed against the urging force of compression coil spring 5 in the case of the piano action device arranged as described above., it is swung counter-clockwise around shaft 4 in FIG. 1. The lower end surface of hammer-pushing projection 12 which moves together with key 2 pushes pressing-force receiving surface 24 of first hammer arm 21, so that first hammer arm 21 is swung clockwise around shaft 28 from its initial position shown by a solid line to its acting position shown by one-dot-chain line in FIG. 1. Pushing-up portion 25 of first hammer arm 21 thus swung pushes up pushing-up force receiving surface 33 of second hammer arm 22, second hammer arm 22 is swung counter-clockwise around shaft 36 from its initial position shown by a solid line to its acting position shown by one-dot-chain line in FIG. 1. Resistance force generated by weight 27 which urges first hammer arm 21 counter-clockwise in FIG. 1 acts, as an action load, on the lower end surface of hammer-pushing projection 12 of key 2 through pressing-force receiving surface 24 of first hammer arm 21. Further, resistance force generated by weight 65 which urges second hammer arm 22 clockwise in FIG. 1 also acts, as an action load, on the lower end surface of hammer-pushing projection 12 of key 2 through first hammer arm 21. These action loads applied from first and second hammer arms 21 and 22 to projection 12 of key 2 make the player feel that key 2 is heavy, so that he or she can feel key 2 as if he or she were depressing keys of an acoustic piano.

Second hammer arm 22 which is swung counter-clockwise in FIG. 1 by first hammer arm 21 pushes first and second switches 41 and 42 at the same time by its switch-pushing surface 32, as shown by one-dot-chain line in FIG. 1. When switch-pushing surface 32 of second hammer arm 22 pushes the lower end surface of pressing-force receiving portion 56 of first switch 41, outer wall portion 54 of first switch 41 is elastically transformed to make movable contact 57 contact paired fixed contacts 58 and 59 at the same time. Paired fixed contacts 58 and 59 are thus electrically connected to each other to close first switch 41 . Second switch 42 pushed by switch-pushing surface 32 of second hammer arm 22 is similarly closed after the lapse of time interval (t). When second switch 42 is closed, data is applied to the sound source means to start its generation of musical sounds. Further, touch response data (that is, data for determining parameters such as sound volume and tone color of those musical sounds generated by the sound source means) is outputted corresponding to time interval (t) (i.e. key-depressing speed).

When the depressing force applied to key 2 is released, key 2 is returned to its initial position shown in FIG. 1 by the urging force of compression coil spring 5. A little later, first hammer arm 21 is returned from its acting position to its initial position by the action of weight 27, and second hammer arm 22 is then returned from its acting position to its initial position by the action of weight 35.

Figure 4A:
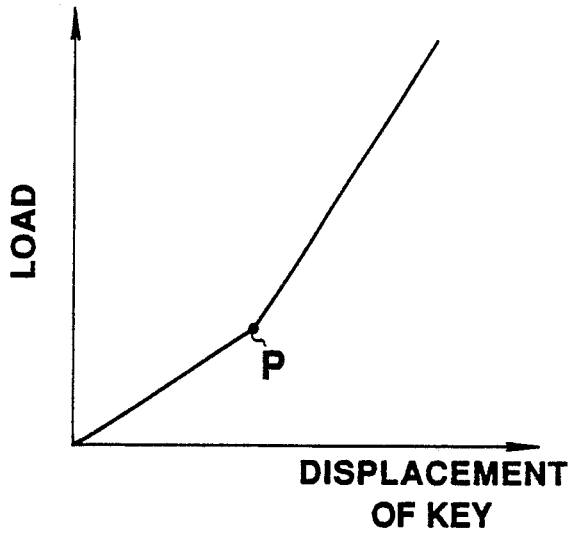
FIGS. 4A and 4B are graphs schematically showing relations between a displacement of a key and a load applied to the key when a key provided in the piano action device of FIG. 1 is strongly and lightly depressed.

The relationship between the displacement of key 2 and the load applied to key 2 when key 2 is lightly depressed, is shown in FIG. 4A. That is, in initial condition when first hammer arm 21 starts its movement due to the rotation of key 2, heavy load, which is the sum of the urging force of compression coil spring 5, the resistance force generated by weight 27 of first hammer arm 21 and the resistance force generated by weight 65 of second hammer arm 22, temporarily acts on key 2. After time point Pl when key 2 is swung to some extent, load generated at a time when the end portion of second hammer arm 22 presses the first and second switches 41, 42 further acts on key 2. Still later, after time point P2, load generated at a time when key 2 presses down buffer member 10 still further acts on key 2.

Figure 4B:
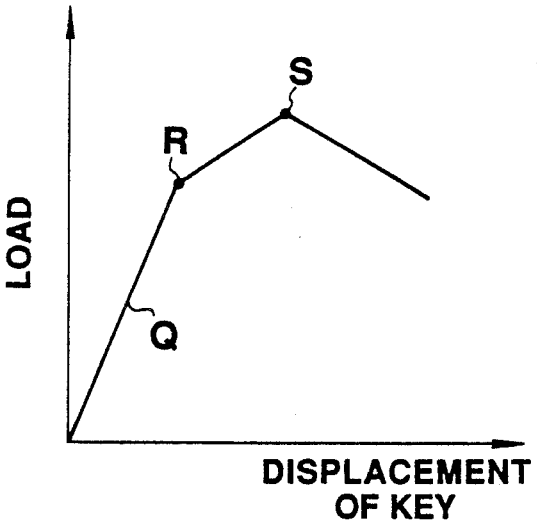

The relationship between the displacement of key 2 and the load applied to key 2 when key 2 is strongly depressed, is shown in FIG. 4B.

That is, in an initial condition just after key 2 starts its swingable movement, heavy load which is the sum of the urging force of compression coil spring 5, resistance force of first hammer arm 21 caused by weight 27 and resistance force of second hammer arm 22 caused by weight 65 acts on key 2, as shown by reference mark Q in FIG. 4B. After time point R when key 2 is swung to some extent, the resistance force of second hammer arm 22 caused by weight 65 does not act on key 2 by the inertial force of weight 65. After time point S when key 2 is further swung, the resistance force of first hammer arm 21 caused by weight 27 does not act on key 2 due to the inertial force of weight 27. Still later, after time point T, load generated at a time when key 2 presses down buffer member 10 acts on key 2.

When key 2 is strongly depressed, as described above, in the case of the piano action device of the first embodiment, the load applied to key 2, between the time point R which occurs during displacement of key 2 and the time point when key 2 starts to press down buffer member 10, becomes gradually small, so that the resistance forces of first and second hammer arms 21 and 22 are not simultaneously and instantly released from key 2 while key 2 is being swung. This prevents the player from feeling bewildered as if key 2 became light instantly after the time point R which occurs during the displacement of key 2, when he or she depresses key 2.

Further, the amount of swinging of key 2 can be amplified by first hammer arm 21 and further amplified by second hammer arm 22 in the case of the above described piano action device. Therefore, the movement of second hammer arm 22 which serves to push first and second switches 41 and 42 can be made large in a small space.

Second Embodiment

Figure 5:
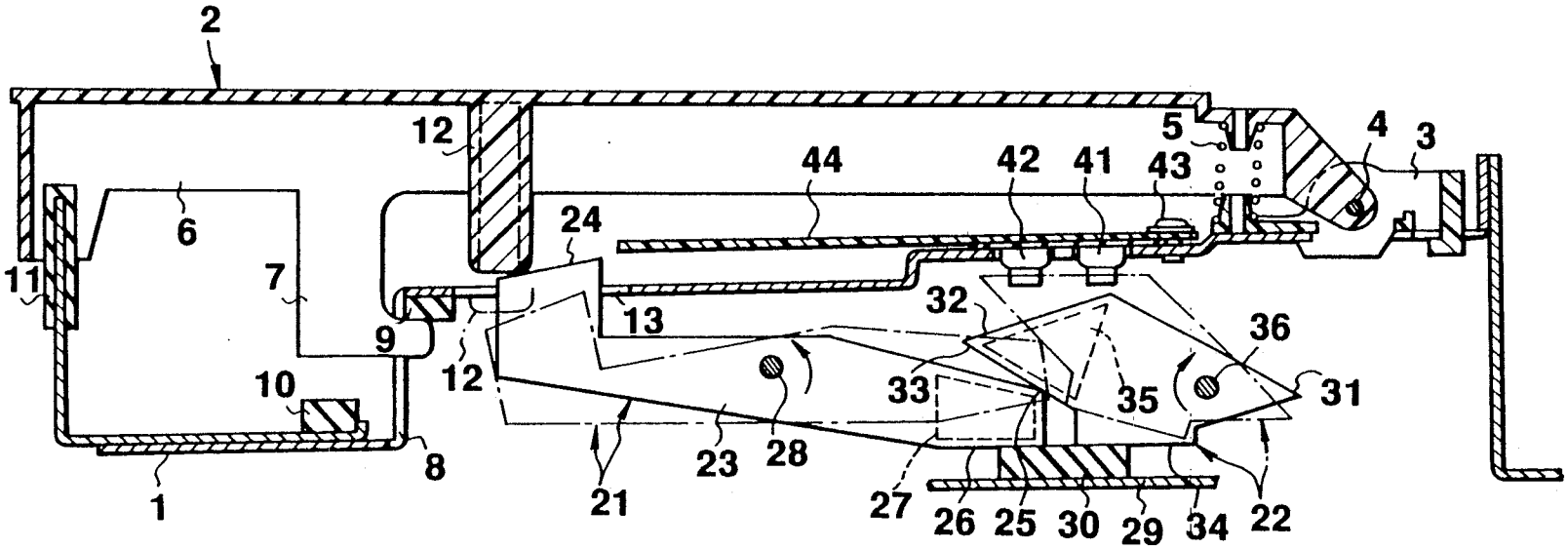
FIG. 5 is a longitudinal section view schematically showing a main part of a second embodiment of a piano action device, according to the present invention.

FIG. 5 schematically shows a longitudinal section of a main part of a second embodiment of a piano action device according to the present invention and used in electronic keyboard musical instruments. The same components as those of the above described first embodiment will be denoted by the same reference numerals, and description of these components will be omitted.

Hammer pushing projection 12 is mounted on the front portion of the lower surface of key 2 in this second embodiment. Therefore, in the piano action device of the second embodiment, first and second hammer arms 21 and 22 and circuit board 44 provided with first and second switches 41 and 44 are attached to keyboard chassis 1 and body housing 29 in such a way that they are reversely arranged in the longitudinal direction of key 2 in comparison with the piano action device of the first embodiment. The action of the piano action device of the second embodiment is similar to that of the first one, and description on this action will be omitted.

Even if key 2 is strongly and lightly depressed in the case of the piano action device of the second embodiment the same technical advantages as seen in the case of the above described first embodiment can be obtained.

Further, since hammer-pushing projection 12 is mounted on the front portion of the lower surface of key 2 in the piano action device of the second embodiment, the downward displacement of projection 12 caused by the swingable movement of key 2 can be made larger than that in the piano action device in which projection 12 is mounted on the rear end of the lower surface of key 2. Particularly when key 2 is small-sized and its displacement is small, therefore, sufficient swingable displacement can be guaranteed for first and second hammer arms 21 and 22, respectively. As the result, addition of an action load to key 2 through two hammer arms 21 and 22, and switching-on of first and second switches 41 and 42 can be well achieved as seen in the first embodiment.

Third Embodiment

Figure 6:
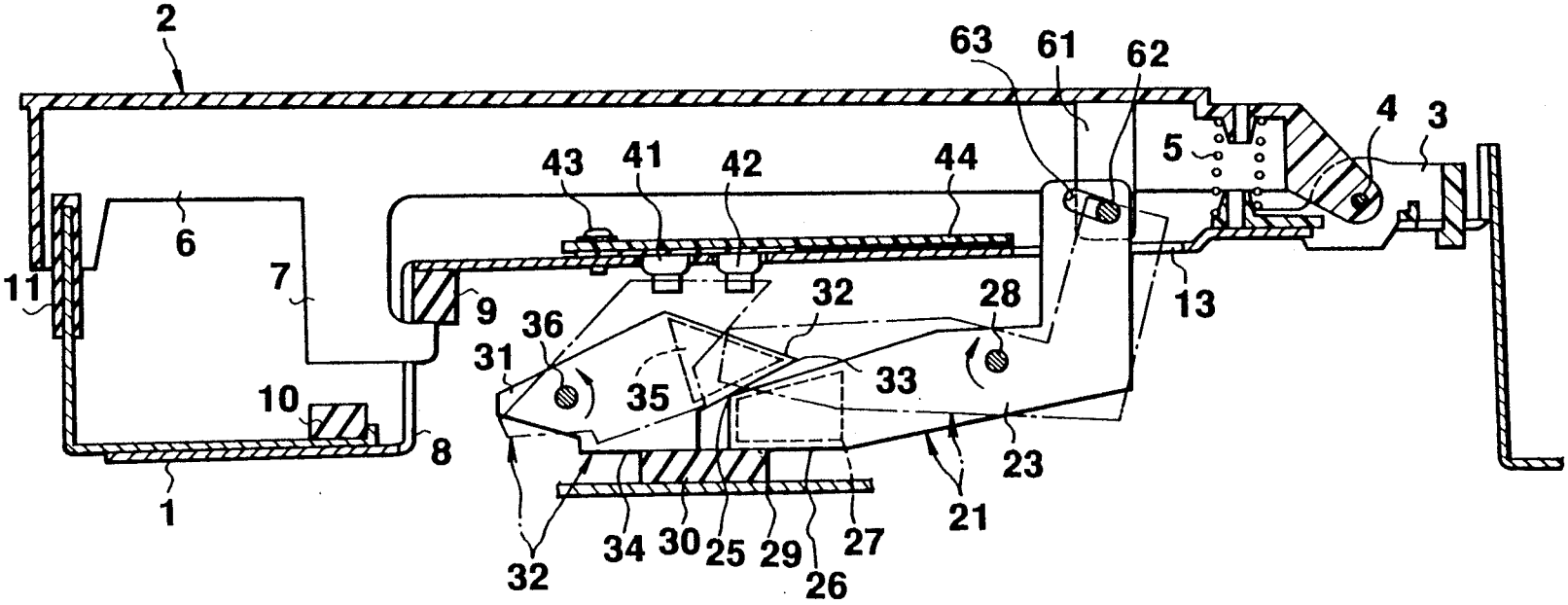
FIG. 6 is a longitudinal sectional view schematically showing a main part of a third embodiment of a piano action device, according to the present invention.

FIG. 6 schematically shows a longitudinal section of a main part of a third embodiment of a piano action device according to the present invention and used in electronic keyboard musical instruments. The same components as those of the above described first embodiment will be denoted by the same reference numerals, and description of these components will be omitted.

In the piano action device of this third embodiment instead of the hammer pushing projection denoted by reference numeral 12 in FIG. 1, a pair of hammer connecting projections 61 (only one of them shown) are mounted on the rear end portion of the lower surface of key 2 so as to be separated from each other in the width direction of key 2 and arranged in parallel with each other. Paired projections 61 support connecting pin 62 at their respective lower end portions so as to cross then at right angles. Body 23 of first hammer arm 21 has slot 63 at the upper end of the upwardly-extending portion of its rear end, and connecting pin 62 is inserted into slot 63. The action of the piano action device of the third embodiment is similar to that of the one of the first embodiment, therefore description about this action will be omitted.

When key 2 is strongly depressed in the case of the piano action device of this third embodiment, the prior swinging of first hammer arm 21 to the rotation of key 2 needed after key 2 is swung to some extent can be guaranteed by slot 63 of first hammer arm 21.

Even if key 2 is strongly and lightly depressed, the piano action device of the third embodiment can also obtain the same technical advantages as those by the piano action device of the first embodiment.

Fourth Embodiment

Figure 7:
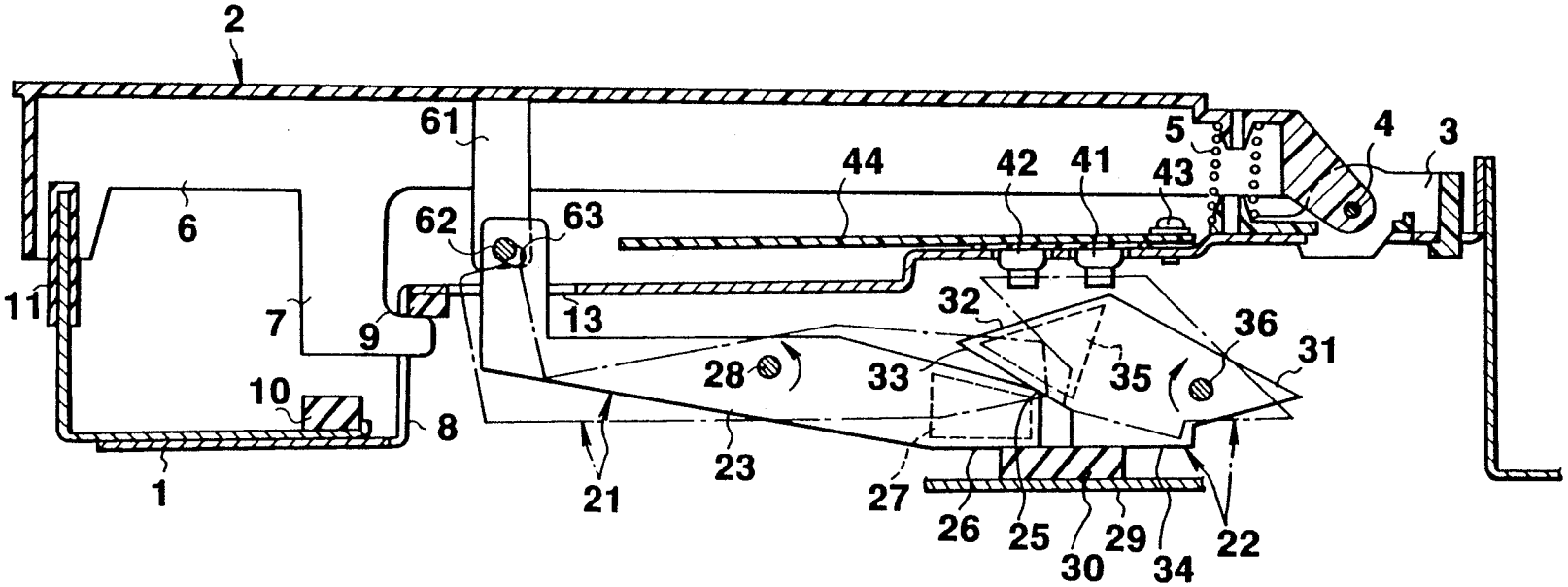
FIG. 7 is a longitudinal sectional view schematically showing a main part of a fourth embodiment of a piano action device, according to the present invention.

FIG. 7 schematically shows a longitudinal section of a main part of a fourth embodiment of a piano action device according to the present invention and used in electronic keyboard musical instruments. The same components as those of the first and third embodiments shown in FIGS. 1 and 6 will be denoted by the same reference numerals, and description of these components will be omitted.

In this fourth embodiment, a pair of hammer connecting projections 61 are mounted on the front portion of the lower surface of key 2. Therefore, first hammer arm 21, second hammer arm 22 and circuit board 44 provided with first and second switches 41 and 42 are attached to keyboard chassis 1 and instrument body housing 29 in such a way that they are reversely arranged in the longitudinal direction of key 2 in comparison with the piano action device of the first embodiment. The action of the piano action device of the fourth embodiment can be apparent from the above description about first and third embodiments, so that description about the action will be omitted.

The same technical advantages as seen in the first and third embodiments can be obtained by the piano action device of this fourth embodiment.

Fifth Embodiment

Figure 8:
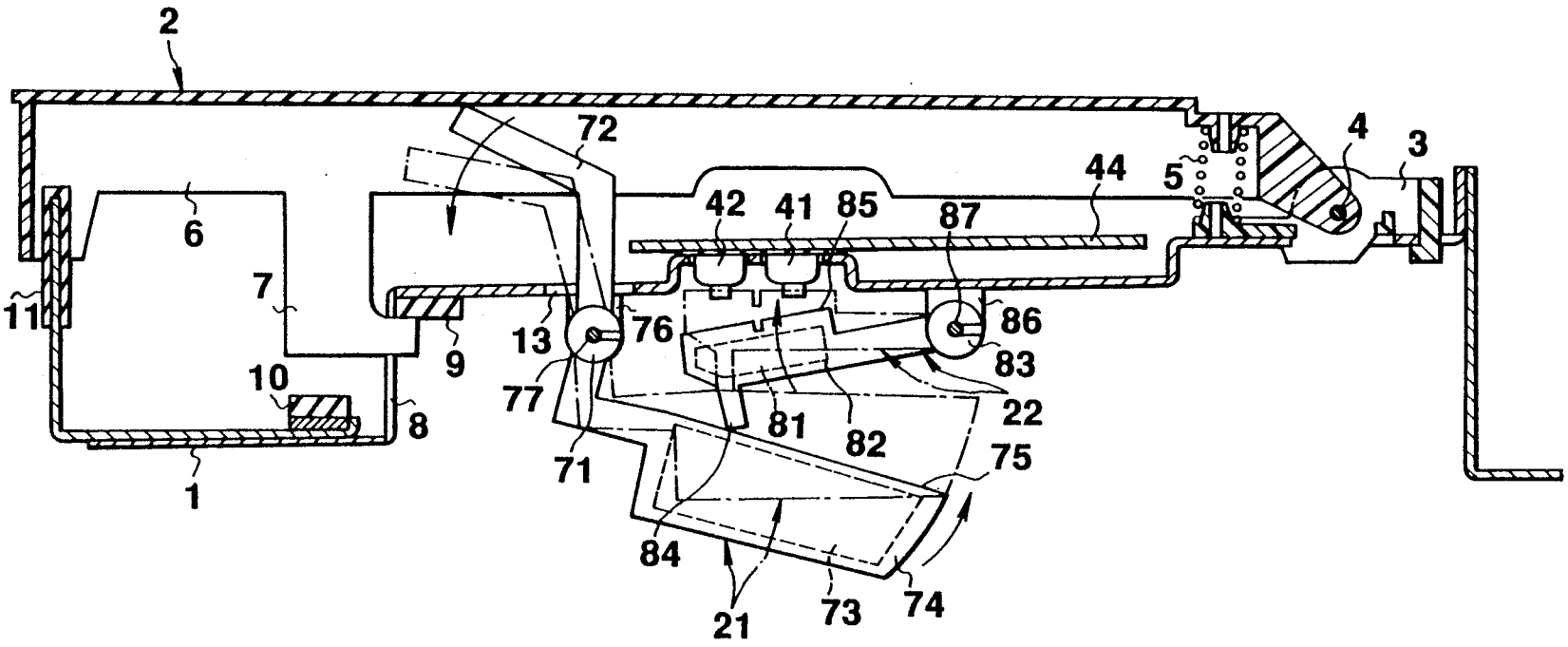
FIG. 8 is a longitudinal sectional view schematically showing a main part of a fifth embodiment of a piano action device, according to the present invention.

FIG. 8 schematically shows a longitudinal section of a main part of a fifth embodiment of a piano action device according to the present invention and used in electronic keyboard musical instruments. The same components as those of the first embodiment shown in FIG. 1 will be denoted by the same reference numerals, and description of these components will be omitted.

In the piano action device of the fifth embodiment, first hammer arm 21 is shaped substantially like capital letter L, and C-shaped shaft supporting portion 71 is mounted on the lower end portion of the upwardly-extending branch of first hammer arm 21. Horizontally extending pressing-force receiving portion 72 is formed in the upper end of the upwardly-extending branch of arm 21. Weight 73, is mounted in horizontally-extending branch 74 of first hammer arm 21, and the upper surface of horizontally-extending branch 74 constructs pushing-up surface 75. The upwardly-extending branch of first hammer arm 21 is inserted into through-hole 13 formed in keyboard chassis 1, and its pressing-force receiving portion 72 contacts the lower surface of key 2. Shaft 77, which is supported at its both ends by a pair of first hammer support members 76 mounted on the lower surface of keyboard chassis 1, is forcibly fitted in shaft support portion 71, so that first hammer arm 21 can be swung up and down around shaft 77. Body 82 of second hammer arm 22 is located above horizontally-extending branch 74 of first hammer arm 21, and extends in the longitudinal direction of key 2. Weight 81 is mounted in the rear end portion of body 82 and C-shaped shaft supporting portion 83 is mounted on the front end portion thereof. Pushing-force receiving portion 84 projected downward is formed on the lower surface of the rear end portion of body 82, and the upper surface of the rear end portion of body 82 constructs switch-pushing surface 85. Shaft 87, which is supported at its both ends by a pair of second hammer support members 86 mounted on the lower surface of keyboard chassis 1, is forcibly fitted into shaft-supporting portion 83, and second hammer arm 22 is freely swingable up and down around shaft 87. Second hammer arm 22 makes its pushing-force receiving portion 84 contact pushing-up surface 75 of horizontally-extending branch 74 of first hammer arm 21, while it makes its switch pushing surface 85 locate under first and second switches 41 and 42 mounted on the lower surface of keyboard chassis 1. The action of the piano action device of this fifth embodiment is similar to that of the first embodiment, so that description about the action will be omitted.

In the piano action device of this fifth embodiment, first hammer arm 21 is actuated by the front portion of key 2 as seen in the second embodiment shown in FIG. 5. Therefore, technical advantageous obtained by the first embodiment and further that obtained by the second embodiment can be obtained by the piano action device of this fifth embodiment.

Sixth Embodiment

Figure 9:
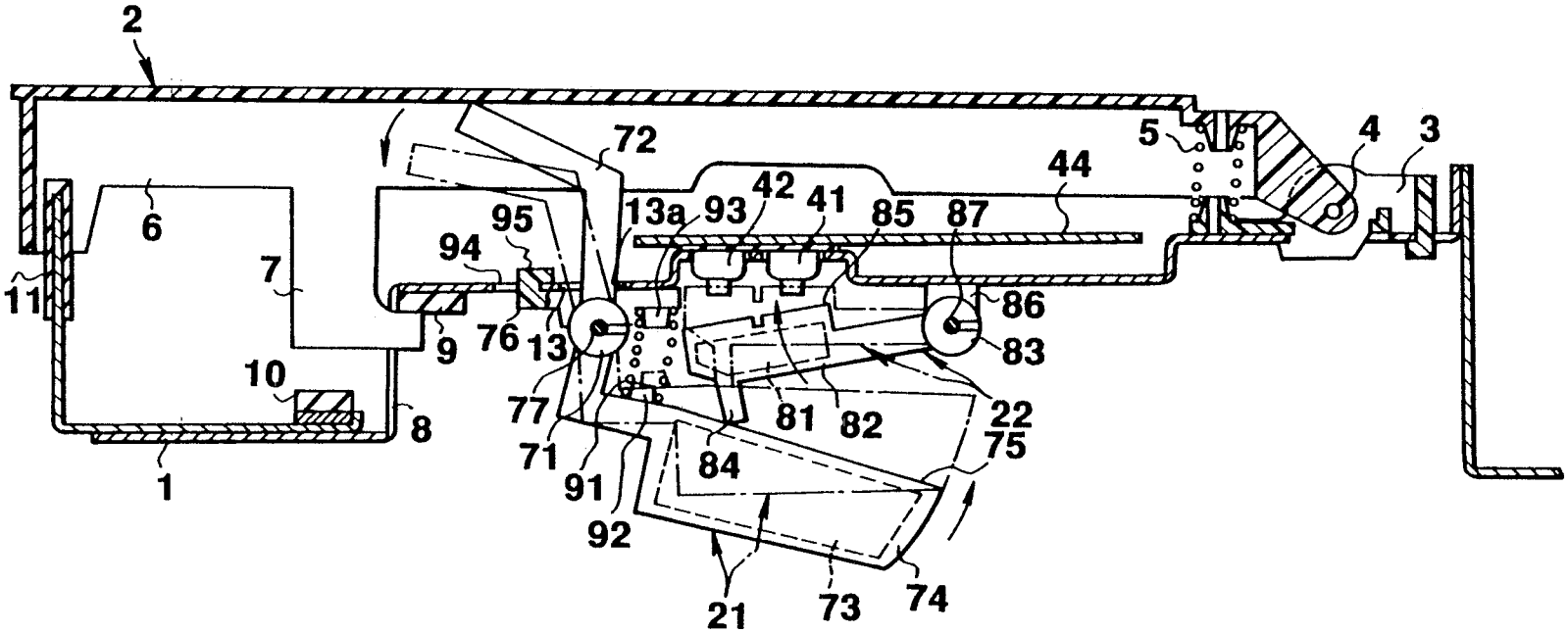
FIG. 9 is a longitudinal sectional view schematically showing a main part of a sixth embodiment of a piano action device, according to the present invention.

FIG. 9 schematically shows a longitudinal section of a main part of a sixth embodiment of a piano action device according to the present invention and used in electronic keyboard musical instruments. The same components as those of the fifth embodiment shown in FIG. 8 will be denoted by the same reference numerals, and description of these components will be omitted.

In the piano action device of this sixth embodiment, compression coil spring 91 is mounted between first hammer arm 21 and hammer-supporting member 76 to more effectively prevent first hammer arm 21 from starting its swingable movement quickly when key 2 is strongly depressed. Projections 92 and 93 for supporting upper and lower ends of compression coil spring 91 are formed at certain positions on the upper surface of the rear end portion of horizontally-extending branch 74 of first hammer arm 21 and on the lower surface of hammer supporting member 76. Hammer supporting member 76 includes engaging piece 95 which is engaged with hole 94 formed in keyboard chassis 1. The action of the piano action device of this sixth embodiment is similar to that of the fifth embodiment, except that the swinging of first hammer arm 21 from its initial position to its acting position is resisted by compression coil spring 91. Therefore, the description about the action of the sixth embodiment will be omitted. The same technical advantages as seen in the fifth embodiment can be obtained by the sixth embodiments.

In the piano action device of this sixth embodiment, in order to attach first hammer arm 21 to keyboard chassis 1, shaft supporting portion 71 of first hammer arm 21 is at first forcibly fitted into shaft 77 of hammer supporting member 76 which is not attached to keyboard chassis 1. Then, the upper end of compression coil spring 91 is fitted over spring-support projection 93 of hammer supporting member 76. Pushing-force receiving portion of upwardly-extending portion of first hammer arm 21 is inserted into through-hole 13 of keyboard chassis 1 from the underside thereof, and then engaging piece 95 of hammer supporting member 76 is inserted into hole 94 of keyboard chassis 1 from the underside thereof. First hammer arm 21 is swung in the anticlockwise direction in FIG. 9 to forcibly fit support projection 92 of horizontally-extending branch 74 into the lower end of compression coil spring 91. Finally hammer supporting member 76 is slid rightwardly in FIG. 9 to make its engaging piece 95 engages with hole 94 of keyboard chassis 1. When first hammer arm 21 is attached to keyboard chassis 1 as described above but key 2 is not attached thereto, first hammer arm 21 is urged in the clockwise direction around shaft 77 by the urging force of compression coil spring 91. The swinging of first hammer arm 21 caused by compression coil spring 91 is stopped when the lower end portion of the upwardly-extending branch of first hammer arm 21 contacts the front edge **13*a* of through-hole 13, as shown in FIG. 9. When key 2 is attached to keyboard chassis 1 as shown by a solid line in FIG. 9, the lower surface of key 2 pushes the projected end of pressing-force receiving portion 72 of first hammer arm 21. First hammer arm 21 is thus swung in the anticlockwise direction around shaft 72 against the urging force of compression coil spring 91, and the lower end portion of the upwardly-extending branch of first hammer arm 21 is separated only by a predetermined distance from the front edge 13*a* of through-hole 13 of keyboard chassis 1**.

Seventh Embodiment

Figure 10:
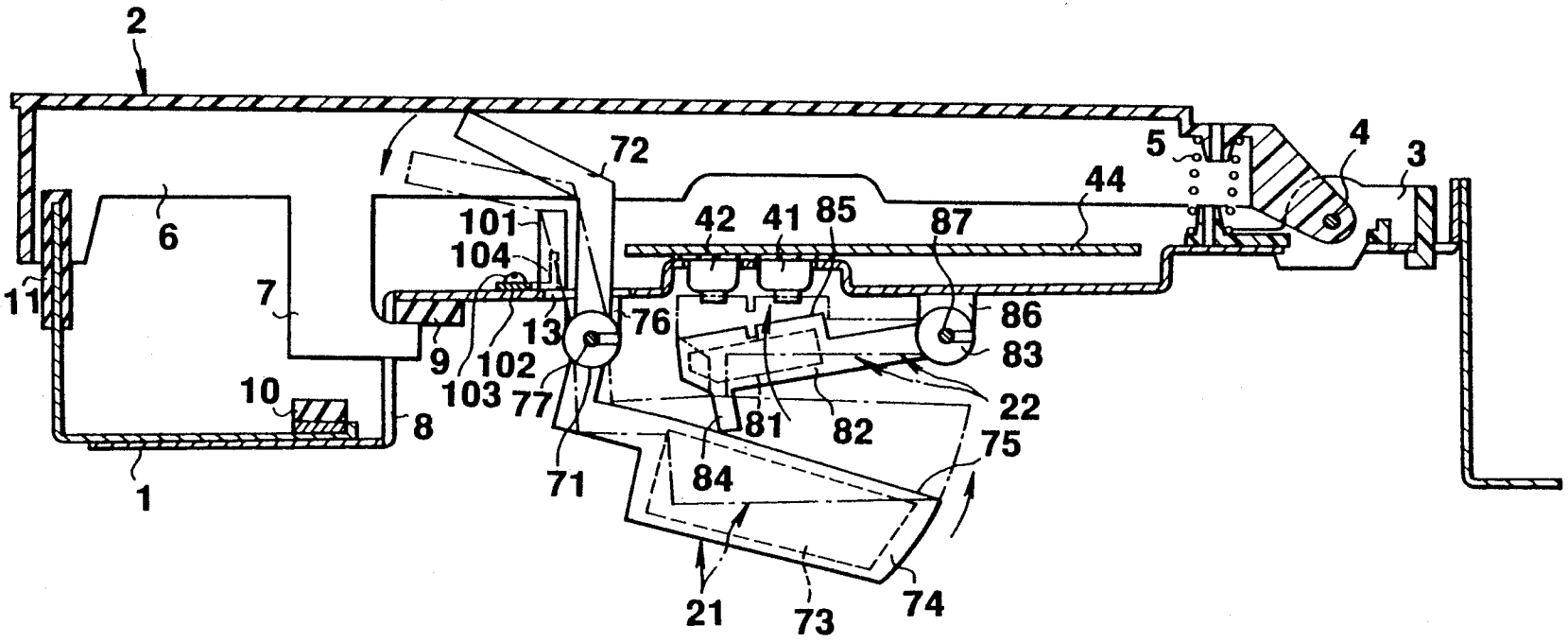
FIG. 10 is a longitudinal sectional view schematically showing a main part of a seventh embodiment of a piano action device, according to the present invention.

FIG. 10 schematically shows a longitudinal section of a main part of a seventh embodiment of a piano action device according to the seventh embodiment and used in electronic keyboard musical instruments. The same components as those of the fifth embodiment shown in FIG. 8 will be denoted by the same reference numerals, and description of these components will be omitted.

In the piano action device of this seventh embodiment, a pair of guide members 101 (one of them shown) are mounted on the upper surface of keyboard chassis 1 to prevent first hammer arm 21 from shaking right and left and increase the resistance force of first hammer arm 21 relative to the depression of key 2. Paired guide members 101 are formed integral on a pair of erected pieces 104 (one of them shown) of guide supporting member 102 which are fixed by screws 103 at a predetermined position on the upper surface of keyboard chassis 1. When key 2 is depressed to swing first hammer arm 21 in the anticlockwise direction in FIG. 10, pressing-force receiving portion 72 of the upwardly-extending branch of first hammer arm 21 enters into a gap between paired guide members 101, thereby preventing first hammer arm 21 from shaking right and left. Further, pressing-force receiving portion 72 of arm 21 slides on inner edges of paired guide members 101 to thereby generate frictional resistance force. This frictional resistance force increases the resistance force of arm 21 relative to key 2, and heavier action load is applied to key 2, as compared with the fifth embodiment shown in FIG. 8. Both inner edges of paired guide members 101 and/or both outer edges of pressing force receiving portion 72 of arm 21 may be tapered to enable pressing force receiving portion 72 of first hammer arm 21 to be smoothly inserted into and detached from the gap between paired guide members 101. The action of the piano action device of this seventh embodiment is similar to that of the fifth embodiment, except that the swinging of first hammer arm 21 from its initial position to its acting position is resisted by paired guide members 101. Therefore, description of the action will be omitted. The same technical advantages as seen in the fifth example can be obtained by the seventh example.

Eighth Embodiment

Figure 11:
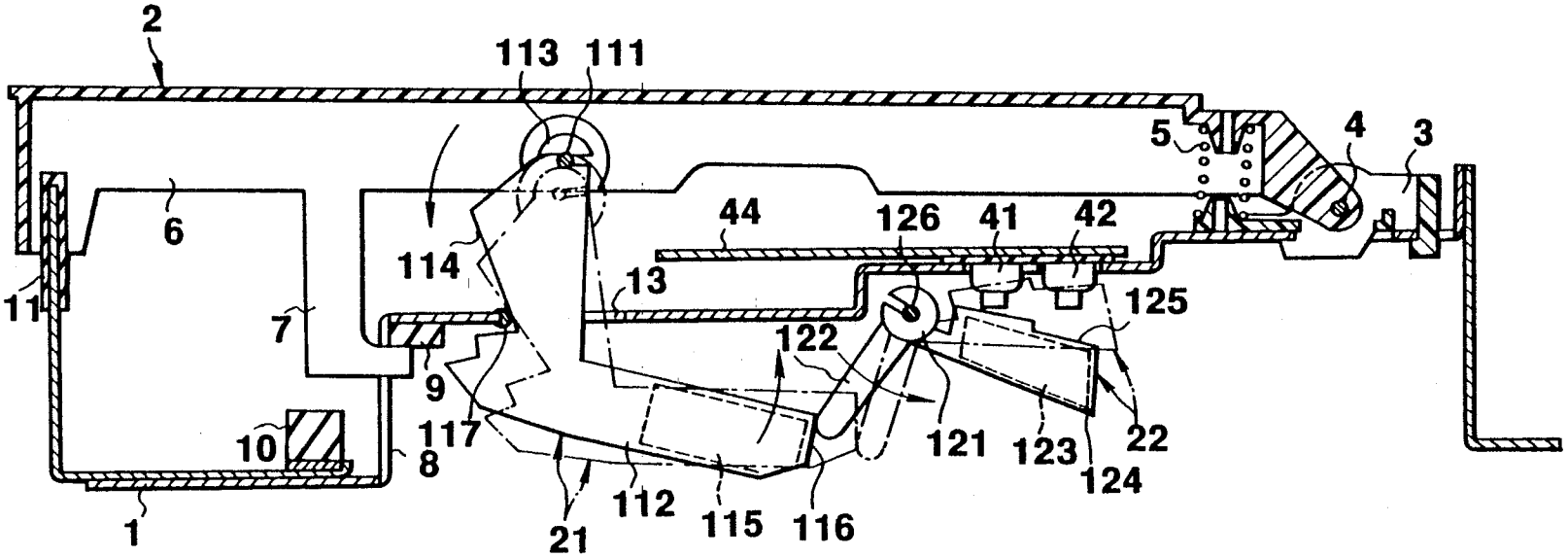
FIG. 11 is a longitudinal sectional view schematically showing a main part of an eighth embodiment of a piano action device, according to the present invention.

FIG. 11 schematically shows a longitudinal section of a main part of an eighth embodiment of a piano action device according to the present invention and used in electronic keyboard musical instruments. The same components as those of the fifth embodiments shown in FIG. 8 will be denoted by the same reference numerals, and description of these components will be omitted.

In the eight embodiment, shaft 111 is mounted at substantially center of key 2 in the longitudinal direction thereof with its both ends being supported by both side plates of key 2. C-shaped shaft supporting portion 113 which is mounted on the upper end of an upwardly-extending branch of L-shaped body 112 of first hammer arm 21 is freely swingably attached to shaft 111. The rear edge of the upwardly-extending branch of body 112 constructs guide surface 114 rearwardly lowering. Weight 115 is mounted in the front end portion of a horizontally-extending branch of body 112 of first hammer 21, and the front end portion of this horizontally-extending branch constructs pushing surface 116. The upwardly-extending branch of first hammer arm 21 is inserted into through-hole 13 of keyboard chassis 1, so that the horizontally-extending branch thereof is located under keyboard chassis 1. The lower end portion of guide surface 114 of the upwardly-extending branch of first hammer arm 21 contacts guide member 117 located at the rear edge of through-hole 13 of keyboard chassis 1, as shown in FIG. 11, and made of synthetic resin such as polytetrafluoroethylene. Second hammer arm 22 includes C-shaped shaft supporting portion 121 freely swingably fitted on shaft 126 supported on the lower surface of keyboard chassis 1, rod-like pressing-force receiving portion 122 extending from shaft supporting portion 121 to pushing surface 116 of the front end of the horizontally-extending branch of first hammer arm 21, and weight portion 124 extending forwardly and downwardly from shaft supporting portion 121 and provided with weight 123. Weight portion 124 extends under first and second switches 41 and 42 on the lower surface of keyboard chassis 1, and its upper surface constructs switch-push surface 125.

When key 2 is depressed against the urging force of compression coil spring 5 in the case of the piano action device of the eighth embodiment, it is swung in the anticlockwise direction around shaft 4 in FIG. 11. The downward movement of shaft 111 caused by swinging key 2 causes first hammer arm 21 to be moved downward. First hammer arm 21 swings in the anti-clockwise direction around shaft 111 in FIG. 11 with sliding its guide surface 114 on guide member 117 at the rear edge of through-hole 13 of keyboard chassis 1. First swinging hammer arm 21 pushes pressing-force receiving portion 122 of second hammer arm 22 by its pushing surface 116, thereby causing second hammer arm 22 to be swung in the anticlockwise direction around shaft 126 in FIG. 11. In this state, the resistance force of first hammer arm 21 caused by weight 115 acts, as an action load, on key 2 through shaft 111, while the resistance force of second hammer arm 22 caused by weight 124 also acts, as an action load, on key 2 through first hammer arm 21. When switch-pushing surface 125 of second hammer arm 22 simultaneously pushes first and second switches 41 and 42, as shown by one-dot-chain line in FIG. 11, first and second switches 41 and 42 are successively put on at a certain time lag.

In the piano action device of the eighth embodiment, since first hammer arm 21 is connected to shaft 111 of key 2 by shaft supporting portion 113, first hammer arm 21 will not swing prior to the swinging of key 2 even if key 2 is strongly depressed. This prevents key 2 from being instantly released from action load even when key 2 is strongly depressed. This also prevents the player from feeling it bewildered that key 2 becomes light instantly.

Ninth Embodiment

Figure 12:
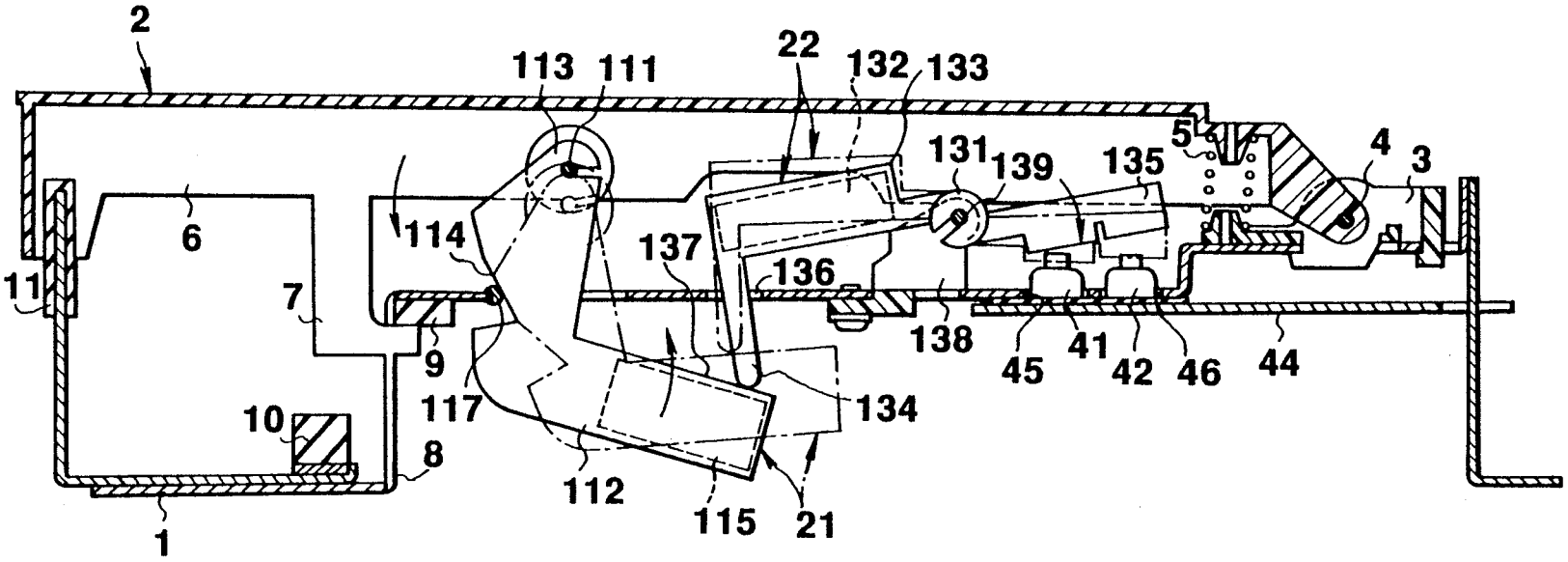
FIG. 12 is a longitudinal sectional view schematically showing a ninth embodiment of a piano action device, according to the present invention.

FIG. 12 schematically shows a longitudinal section of a main part of a ninth embodiment of a piano action device according to the present invention and used in electronic keyboard musical instruments. The same components as those of the eighth embodiment shown in FIG. 11 will be denoted by the same reference numerals, and description of these components will be omitted.

In the case of the first through eighth embodiments shown in FIG. 1 and FIGS. 5 through 11, circuit board 44 is mounted on the upper surface of keyboard chassis 1, and first and second switches 41 and 41 which are mounted on the lower surface of circuit board 44 are passed through through-holes 45 and 46 of keyboard chassis 1 so as to project downward. Second hammer arm 22 for pushing first and second switches 41 and 42 is located under keyboard chassis 1.

In the case of the ninth embodiment, circuit board 44 is fixed to the lower surface of key-board chassis 1. First and second switches 41 and 42 mounted on the upper surface of circuit board 44 are passed through through-holes 45 and 46 of keyboard chassis 1 and projected upward. Second hammer arm 22 for pushing first and second switches 41 and 42 is located above keyboard chassis 1. Substantially C-shaped shaft supporting portion 131 for second hammer arm 22 is freely swingably supported by shaft 139, both ends of which are supported by paired hammer support members 138 mounted on the upper surface keyboard chassis 1. Weight portion 133 in which weight 132 is mounted extends backward from shaft supporting portion 131, and rod-like pressing-force receiving portion 134 is formed at the rear end of weight portion 133 so as to pass through through-hole 136 of key-board chassis 1 and extend downwardly. Switch-push portion 135 extends forwardly from shaft supporting portion 131. The lower end of pressing-force receiving portion 134 of second hammer arm 22 contacts pushing-up surface 137 constructed by the upper surface of a horizontally-extending branch of first hammer arm 21, and switch-push portion 135 of second hammer arm 22 is located above first and second switches 41 and 42. The action of the piano action device of this ninth embodiment can be easily understood from the description above the eighth example shown in FIG. 11, and description of the action will be omitted.

The same technical advantages as seen in the eighth embodiment can be obtained by the piano action device of this ninth embodiment.

Tenth Embodiment

Figure 13:
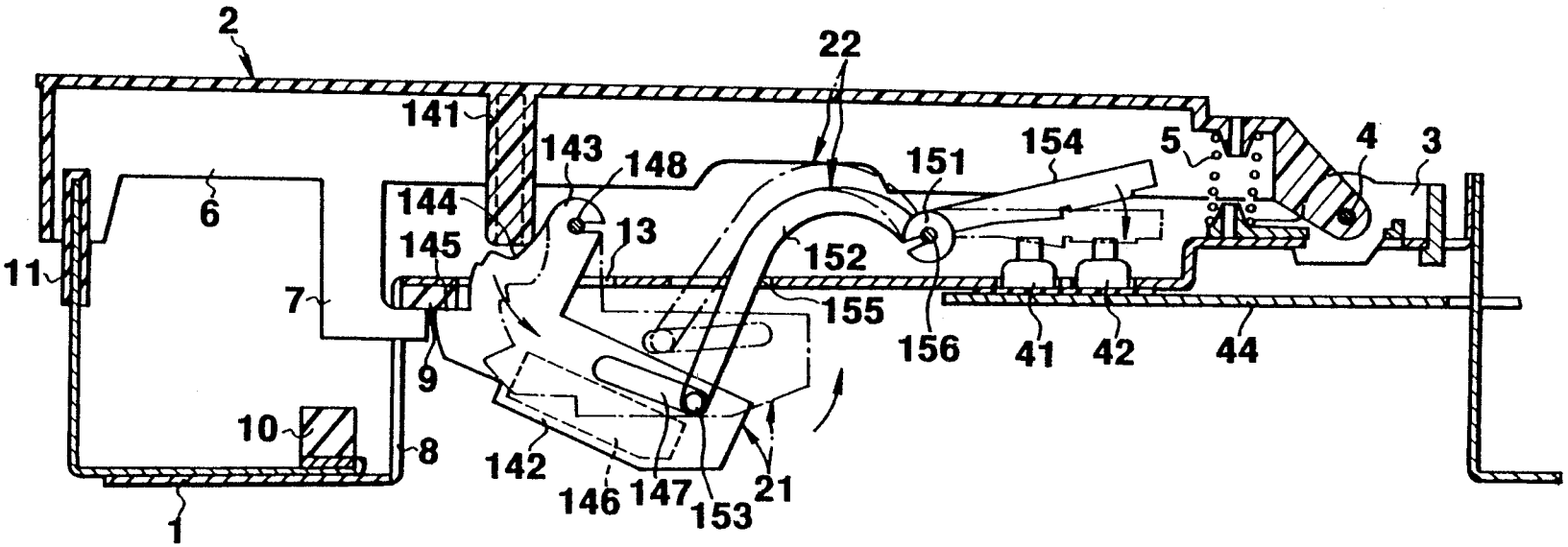
FIG. 13 is a longitudinal sectional view schematically showing a tenth embodiment of a piano action device, according to the present invention.

FIG. 13 schematically shows a longitudinal section of a main portion of a tenth embodiment of a piano action device according to the present invention and used in electronic keyboard musical instruments. The same components as those of the ninth embodiment shown in FIG. 12 will be denoted by the same reference numerals, and description of these components will be omitted.

In the case of the ninth embodiment shown in FIG. 12, key 2 and first hammer arm 21 are connected to each other by shaft 111 but first and second hammer arms 21 and 22 are not connected to each other by a shaft.

In the case of the tenth embodiment, first and second hammer arms 21 and 22 are connected to each other by a connecting pin, but key 2 and first hammer arm 21 are not connected to each other by a shaft.

In the piano-action-device of the tenth embodiment, hammer pushing projection 141 having a substantially H-shaped horizontal section is formed at the front portion of the lower surface of key 2. C-shaped shaft supporting portion 143 is formed at the upper end of an upwardly-extending branch of L-shaped body 142 of first hammer arm 21, and this shaft supporting portion 143 is forcibly fitted on shaft 148 supported on the upper surface of keyboard chassis 1 so as to be freely swingable around shaft 148. A horizontally-extending branch of body 142 is passes through through-hole 13 of chassis 1 and is located under keyboard chassis 1. The rear edge of the upwardly-extending branch of body 142 constructs pressing-force receiving surface 144 having a predetermined shape, and stopper surface 145 orientated upward is formed at the rear end of the horizontally-extending branch of body 142. Weight 146 is mounted in the horizontally-extending branch of body 142, and slot 147 is formed at the upper portion of the horizontally-extending branch of body 142. First hammer arm 21 is in contact at its stopper surface 145 with buffer member 9 mounted on the lower surface of keyboard chassis 1, so that arm 21 resists urging force generated by the action of weight 146 in the clockwise direction. When key 2 is not depressed, pressing-force receiving surface 144 of first hammer arm 21 is lightly contacted or slightly separated from the lower end surface of hammer pushing projection 141 of key 2.

Second hammer arm 22 includes substantially C-shaped shaft supporting portion 151 forcibly fitted on shaft 156 supported on the upper surface of keyboard chassis 1 so as to be freely swingable around shaft 156, connecting arm portion 152 extending backwardly and downwardly from shaft supporting portion 151 and passing through through-hole 155 of keyboard chassis 1, and switch-push portion 154 extending forwardly and upwardly from shaft supporting portion 151 and located above first and second switches 41 and 42 which are projected upward from the upper surface of keyboard chassis 1. Horizontally-extending connecting pin 153 is provided at the lower end of connecting arm portion 152, and connecting pin 153 is inserted into slot 147 of horizontally-extending branch of first hammer arm 21.

When key 2 is depressed against the urging force of compression coil spring 5 in the piano action device of the tenth embodiment, it is swung in the anti-clockwise direction around shaft 4 in FIG. 13. The lower end surface of hammer pushing projection 141 on key 2 pushes pressing-force receiving surface 144 of first hammer arm 21, thereby swinging first hammer arm 21 in the anticlockwise direction around shaft 148 in FIG. 13. The swinging of first hammer arm 21 causes second hammer arm 22, whose connecting pin 153 is inserted into slot 147 of first hammer arm 21, to swing in the clockwise direction around shaft 151 in FIG. 13. The resistance force of first hammer arm 21 caused by weight 146 acts, as an action load, on the lower end surface of hammer pushing projection 141 of key 2 through pressing-force receiving surface 144, and frictional resistance force caused by connecting pin 153 of connecting arm portion 152 of second hammer arm 22 which slides in slot 147 of first hammer arm 21 also acts, as an action load, on the lower end surface of hammer-pushing projection 141 of key 2 through first hammer arm 21. When switch-push portion 154 of second hammer arm 22 pushes first and second switches 41 and 42 at the same time, as shown by one-dot-chain line in FIG. 13, first and second switches 41 and 42 are successively turned on at a certain time lag.

The same technical advantages as seen in the ninth embodiment shown in FIG. 11 can be obtained by the piano action device of the tenth embodiment.

Eleventh Embodiment

Figure 14:
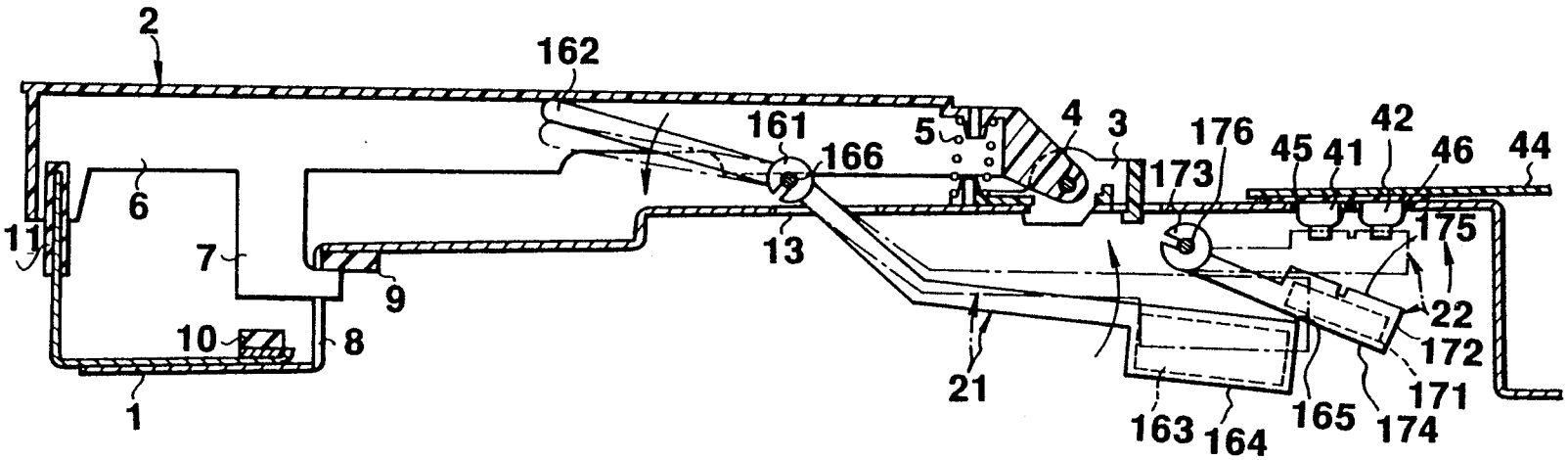
FIG. 14 is a longitudinal sectional view schematically showing an eleventh embodiment of a piano action device, according to the present invention.

FIG. 14 schematically shows a longitudinal section of a main part of an eleventh embodiment of a piano action device according to the present invention and used in electronic keyboard musical instruments. The same components as those in the fifth embodiment shown in FIG. 8 will be denoted by the same reference numerals, and description of these components will be omitted.

In the case of the first through tenth embodiments shown in FIG. 1 and FIGS. 5 through 13, first and second switches 41 and 42 are located under key 2, but they are located in front of key 2 in the case of this eleventh embodiment.

Circuit board 44 is mounted on the upper surface of keyboard chassis 1 so as to be located in front of key 2. First and second switches 41 and 42 mounted on the lower surface of circuit board 44 pass through through-holes 45 and 46 of keyboard chassis 1, and downwardly project from the lower surface of key board chassis 2.

First hammer arm 21 includes C-shaped shaft supporting portion 161 forcibly fitted onto shaft 166 so as to be freely swingable around shaft 166, shaft 166 being located under key 2 and supported on the upper surface of keyboard chassis 1, pressing-force receiving portion 162 extending forwardly and upwardly from shaft supporting portion 161 and contacting the lower surface of key 2, and weight portion 164 extending rearwardly and downwardly from shaft supporting portion 161 and passing through through-hole 13 of keyboard chassis 1. Weight 163 is mounted in weight portion 164 under keyboard chassis 1. Pushing-up portion 165 having a semi-spherical section is formed on the front edge of the upper surface of weight portion 164.

Second hammer arm 22 includes C-shaped shaft supporting portion 173 forcibly fitted onto shaft 176 so as to be freely swingable around shaft 176, shaft 176 being located above weight portion 164 of first hammer arm 21 and supported on the lower surface of keyboard chassis 1, and body 172 extending forwardly from shaft supporting portion 173 and provided with weight 171. The lower surface of body 172 constructs pushing-up force receiving surface 174, and the upper surface thereof constructs switch-push surface 175. Pushing-force receiving surface 174 of second hammer arm 22 is placed on pushing-up portion 165 of weight portion 164 of first hammer arm 21, so that its switch-push surface 175 is located under first and second switches 41 and 42.

The action of the piano action device of the eleventh embodiment can be easily understood from the description about the first and fifth embodiments shown in FIGS. 1 and 8, and description about the action will be omitted.

When key 2 is strongly depressed in the piano action device of eleventh embodiment, the resistance force of second hammer arm 22 caused by weight 171 acts on pushing-up portion 165 of first hammer arm 21 through pushing-up force receiving surface 174 just after key 2 starts its swinging. This prevents first hammer arm 21 from swinging prior to the swinging of key 2. When key 2 swings in some distance and increases its swinging speed to some extent, second hammer arm 22 which lighter in weight than first one 21 swings prior to the swinging of first hammer arm 21. When key 2 further swings and increases its swinging speed to a greater extent, first hammer arm 21 which is lighter in weight than key 2 swings prior to the swinging of key 2.

The same technical advantages as seen in the fifth embodiment shown in FIG. 8 can be obtained by the piano action device of this eleventh embodiment, as described above.

Twelfth Embodiment

Figure 15:
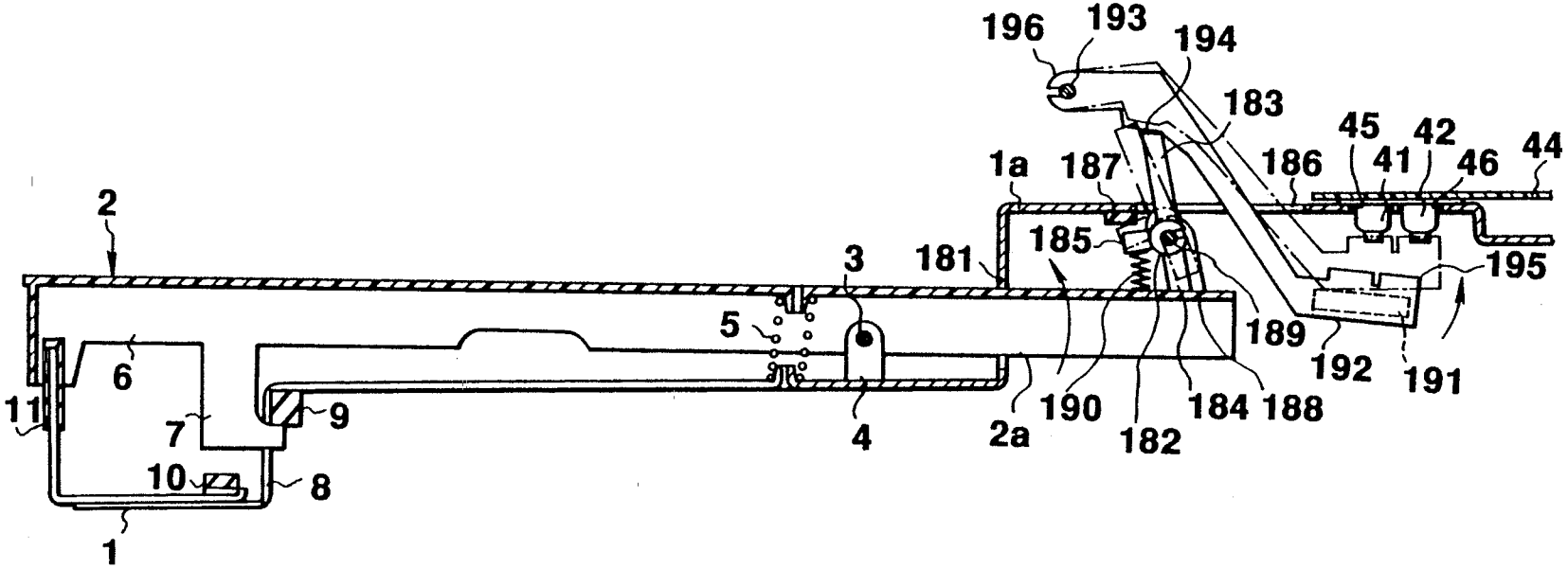
FIG. 15 is a longitudinal sectional view schematically showing a twelfth embodiment of a piano action device, according to the present invention.

FIG. 15 schematically shows a longitudinal section of a main port of a piano action device of a twelfth embodiment according to the present invention and used in electronic keyboard musical instruments. The same components as those in the eleventh example shown in FIG. 14 will be denoted by the same reference numerals, and description of these components will be omitted.

In the case of the first through eleventh embodiments shown in FIG. 1 and FIGS. 5 through 14, first and second hammer arms 21 and 22 are located below key 2 in the vertical direction, but they are mounted in front of key 2 so as to be located above key 2 in the vertical direction.

In the piano action device of this twelfth embodiment, key 2 is further extended in the forward direction from its swinging center shaft 4 to some extent, and this forwardly-extending portion 2*a* passes through vertical through-hole 181 formed in chassis 1 and is located under upwardly-bulging front end portion 1*a* of keyboard chassis 1. First and second switches 41 and 42 are mounted on the lower surface of circuit board 44, which is fixed on the upper of front end portion 1*a* of keyboard chassis 1, and pass through through-holes 45 and 46 formed at front end portion 1*a* of keyboard chassis 1 so as to project downward from the lower surface of front end portion 1*a*. A pair of hammer-supporting members 188 are formed on the upper surface of forwardly-extending portion 2*a* of key 2 to support both ends of shaft 189.

First hammer arm 21 includes C-shaped shaft supporting portion 182 forcibly fitted onto shaft 189 so as to be freely swingable around shaft 189, shaft 189 being provided on forwardly-extending portion 2*a* of key 2, rod-like pushing-up portion 183 extending upwardly from shaft-supporting portion 182 and inserted into through-hole 186 of front end portion la, rod-like stopper portion 184 extending downwardly from shaft-supporting 5 portion 182 and contacting the upper surface of forwardly-extending portion 2*a* of key 2, and stopper receiving portion 185 projecting backwardly from shaft-supporting portion 182. First hammer arm 21 is urged in the clockwise direction in FIG. 15 by the urging force of compression coil spring 190 which is mounted between the lower surface of stopper receiving portion 185 and the upper surface of forwardly-extending portion 2*a* of key 2, but it is held at its initial position by stopper portion 184 whose lower end contacts the upper surface of forwardly-extending portion 2*a* of key 2. In the initial position, stopper receiving portion 185 of first hammer arm 21 is located under buffer stopper 187 which is mounted on the lower surface of keyboard chassis 1 along the rear edge of through-hole 186 of front end portion la of chassis 1.

Second hammer arm 22 includes C-shaped shaft-supporting portion 196 forcibly fitted onto shaft 193 so as to freely swingable around shaft 193, shaft 193 being supported on the front end portion la of keyboard chassis 1, and body 192 extending forwardly and downwardly from shaft-supporting portion 196 and inserted into through-hole 186 at the front end portion 1*a* of keyboard chassis 1. The upper end portion of the rear edge of body 192 constructs pushing-up force receiving surface 194 contacting the upper surface of pushing-up portion 183 of first hammer arm 21, and the upper surface of the front end portion of body 192 constructs switch-push surface 195. Weight 191 is mounted in the front end portion of body 192. Switch-push surface 195 of second hammer arm 22 is located under first and second switches 41 and 42.

When key 2 is depressed against the urging force of compression coil spring 5 in the piano action device of the twelfth embodiment, it is swung in the anticlockwise direction around shaft 4 in FIG. 15. First hammer arm 21 is thus swung in the anticlockwise direction around shaft 189 against the urging force of compression coil spring 190 because its stopper receiving portion 185 strikes against stopper 187 of keyboard chassis 1. Pushing-up portion 183 of first swinging hammer arm 21 pushes up pushing-up force receiving surface 194 of second hammer arm 22, thereby causing second hammer arm 22 to swing in the anticlockwise direction around shaft 193 in FIG. 15. The resistance force of first hammer arm 21 caused by compression coil spring 190 acts, as an action load, on key 2 through shaft 189, and the resistance force of second hammer arm 22 caused by weight 191 also acts, as an action load, on key 2 through first hammer arm 21. When switch-push surface 195 of second hammer arm 22 pushes first and second switches 41 and 42 at the same time, as shown by one-dot-chain line in FIG. 15, first and second switches 41 and 42 are successively turned on at a certain time lag.

In the piano action device of this twelfth embodiment, shaft supporting portion 182 of first hammer arm 21 is also attached to key 2 through shaft 189, as seen in the case of the eighth embodiment shown in FIG. 11. Even when key 2 is strongly depressed, therefore, first hammer arm 21 is not swung prior to the swinging of key 2. This prevents key 2 from being released from the action load in an instant. The player cannot therefore feel it bewildered as if key 2 quickly became light.

Thirteenth Embodiment

Figure 16:
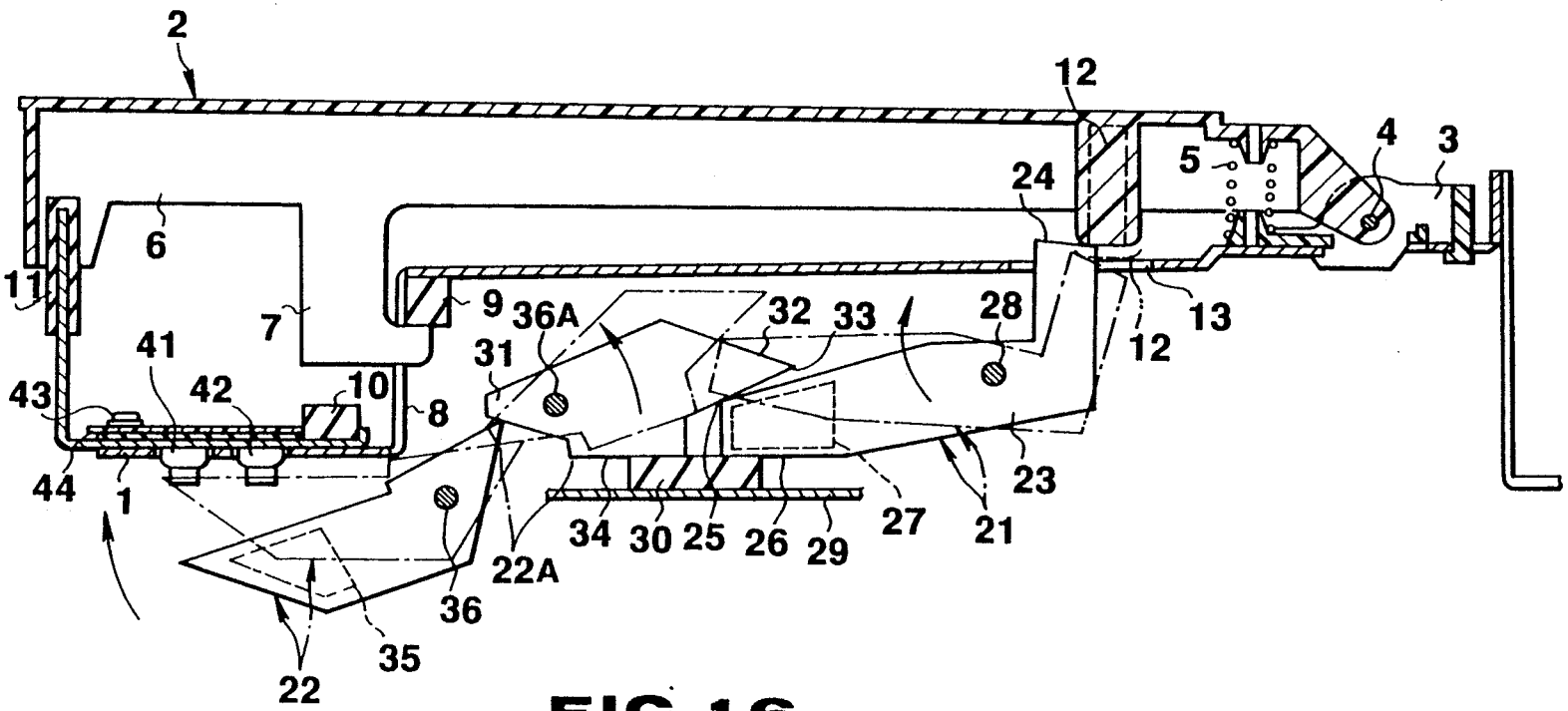
FIG. 16 is a longitudinal sectional view schematically showing a thirteenth embodiment of a piano action device, according to the present invention.

FIG. 16 schematically shows a longitudinal section of a main part of a piano action device of a thirteenth embodiment according to the present invention and used in electronic keyboard musical instrument. The same components as those in the first embodiment shown in FIG. 1 will be denoted by the same reference numerals, and description of these components will be omitted.

In the case of the first through twelfth embodiments shown in FIG. 1 and FIGS. 5 through 15, the pushing action of key 2 is transmitted to first and second switches 41 and 42 through first and second hammer arms 21 and 22. But in the case of the thirteenth embodiment, intermediate transmission arm 22A is interposed between first and second hammer arms 21 and 22.

When key 2 is depressed in the piano action device of the thirteenth embodiment, the swinging of first hammer arm 21 is transmitted to intermediate transmission arm 22A, so that arm 22A swings in the anticlockwise direction around shaft 36A which is supported by keyboard chassis 1 or musical-instrument body housing 29. The swinging of intermediate transmission arm 22A is transmitted to second hammer arm 22, and second hammer arm 22 is thus swung to push first and second switches 41 and 42.

In the case of the first through thirteenth embodiment, first and second switches 41 and 42 which serve to detect touch response data and indicate the sound generator source to start its generating of musical sounds are pushed at the same time by second hammer arm 22, but it may be arranged that first and second switches 41 and 42 are used exclusively to detect touch response data, that a further switch is added to indicate the start of generating musical sounds, and that these three switches are turned on by second hammer arm 22. The number of those switches which are used to detect touch response data is two in the above-described embodiments, three or more switches may be used to get more touch response data.

Figure 17:
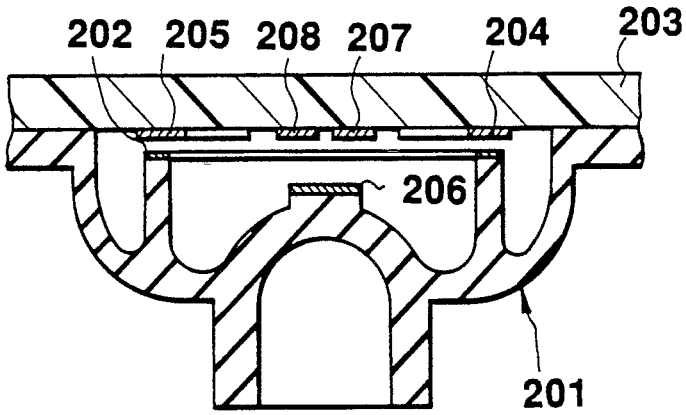
FIG. 17 is an enlarged longitudinal sectional view schematically showing another construction of the first and second switches.

A two-step switch may be used instead of two switches 41 and 42 to detect touch response data. FIG. 17 shows an example of the two-step switch. When the top portion of cap-like switch body 201 made of elastic material is pushed, it is elastically transformed. As the result, first ring-shaped movable contact 202 attached to the inner circumferential surface of switch body 201 contacts a pair of first fixed contacts 204 and 205 on circuit board 203, and second movable contact 206 mounted on the center of the inner circumferential surface of switch body 201 then contacts a pair of second fixed contacts 207 and 208 mounted on circuit board 203 in ring-shaped movable contact 202.

Figure 18:
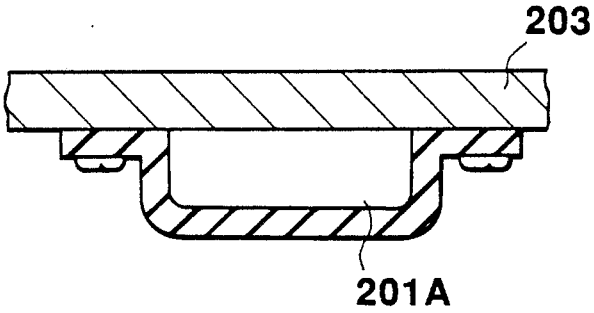
FIG. 18 is an enlarged longitudinal sectional view schematically showing a sensor of the pressure-sensitive type, said sensor being used instead of the first and second switches.

Pressure-sensitive sensor 201A such as the piezoelectric device shown in FIG. 18 may be used instead of first and second switches 41 and 42 which are elastically transformed when they are pushed by second hammer arm 22. Sensor 201A can generate signal for indicating the sound source means to start its sound generating in response to detection of pressure as well as indicating it to determine characteristics of sounds in response to the speed in the rate of increase of pressure detected.

What is claimed is:

1. A piano action device for electronic keyboard musical instruments, comprising:

a keyboard chassis;

a key mounted on said keyboard chassis so as to be swingable up and down;

an action mechanism located under said key, and including first and second hammer arms, said first hammer arm being swingable up and down in response to the swingable movement of said key, said second hammer arm being swingable up and down in response to the swingable movement of said first hammer arm, a swing center of said first hammer arm and a swing center of said second hammer arm being separated from each other in a longitudinal direction of said key and arranged on substantially the same horizontal plane, and one end of said second hammer arm near said first hammer arm being located on one end of said first hammer arm near said second hammer arm thereby transmitting the swingable movement of said first hammer arm to said second hammer arm to cause it to swing; and means for detecting a swing speed of said second hammer arm and generating a musical-sound-characteristic indicating signal to control characteristics of musical sounds to be generated in response to the detected swing speed of said second hammer arm.

2. The piano action device for electronic keyboard musical instruments according to claim 1, wherein said device further comprises a buffer member on which at least one of said first and second hammer arms is positioned at its rest position when said key is not depressed.

3. The piano action device for electronic keyboard musical instruments according to claim 1, wherein the other end of said first hammer arm near said key extends along a lower surface of said key to be slidably in contact with said lower surface thereby transmitting the swingable movement of said key to said first hammer arm to cause it to swing.

4. The piano action device for electronic keyboard musical instruments according to claim 1, wherein said device further comprises means for swingably attaching the other end of said first hammer arm near said key, and a fulcrum member serving as rotational center of said first hammer arm, at which said first hammer arm is placed to be swingable around it.

5. The piano action device for electronic keyboard musical instruments according to claim 1, wherein said action mechanism further includes an auxiliary hammer arm being swingable up and down in response to the swingable movement of said second hammer arm, a swing center of said auxiliary hammer arm being separated from the swing center of said second hammer arm with the swing center of said second hammer arm being between the respective swing centers of said first and said auxiliary hammer arms in the longitudinal direction of said key, and one end of said second hammer arm near said auxiliary hammer arm being located on the end of said auxiliary hammer arm near said second hammer arm, thereby transmitting the swingable movement of said second hammer to said auxiliary hammer arm to cause it to swing, and said detecting means detects the swing speed of said second hammer arm through the swingable movement of said auxiliary hammer arm.

* * * * *